United States Patent [19]

Obrecht et al.

[11] Patent Number: 4,905,362

[45] Date of Patent: Mar. 6, 1990

[54] CLINCHING TOOL

[75] Inventors: Robert E. Obrecht, Bloomfield Hills; Edward J. Waltonen, Southfield, both of Mich.

[73] Assignee: REO Hydraulics Pierce and Form, Inc., Detroit, Mich.

[21] Appl. No.: 296,622

[22] Filed: Jan. 13, 1989

Related U.S. Application Data

[63] Continuation-in-part of Ser. No. 128,194, Dec. 3, 1987, Pat. No. 4,825,525.

[51] Int. Cl.[4] ..... B23P 11/00

[52] U.S. Cl. ..... 29/243.5; 29/21.1; 29/509; 29/522.1

[58] Field of Search ..... 29/243.5, 243.52, 21.1, 29/522.1, 509; 72/478, 412, 476

[56] References Cited

U.S. PATENT DOCUMENTS

| | | | |
|---|---|---|---|
| 2,811,880 | 11/1957 | Williams . | |
| 3,579,809 | 5/1971 | Wolf et al. | 29/522.1 |
| 3,771,480 | 11/1973 | Johnson . | |
| 3,919,955 | 11/1975 | DuVernay . | |
| 3,934,327 | 1/1976 | Hafner | 29/432 |
| 4,208,776 | 6/1980 | Schleicher | 29/243.5 |
| 4,459,735 | 7/1984 | Sawdon | 29/509 |
| 4,569,111 | 2/1986 | Mutou | 29/522.1 |
| 4,574,453 | 3/1986 | Sawdon | 29/432 |
| 4,574,473 | 3/1986 | Sawdon | 29/798 |
| 4,584,753 | 4/1986 | Eckold et al. | 29/243.5 |
| 4,614,017 | 9/1986 | Eckold et al. | 29/509 |
| 4,658,502 | 4/1987 | Eckold et al. | 29/798 |
| 4,660,403 | 4/1987 | Slasinski | 72/389 |
| 4,722,647 | 2/1988 | Sawdon | 411/180 |

*Primary Examiner*—Daniel C. Crane

*Attorney, Agent, or Firm*—Krass and Young

[57] ABSTRACT

A clinching tool including a punch and a die assembly. The die assembly includes a collet, an anvil pin, and a backing plate. The collet is formed of a relatively thin flat plate and includes a clinching section adjacent one end of the plate and a mounting section adjacent the other end of the plate. A split extends from the clinching end of the plate centrally toward the mounting end of the plate and arcuate cutouts are provided along the opposite side edges of the split to define a die opening intermediate the ends of the split. The working face of the backing plate is positioned against the face of the collet plate remote from the punch and the anvil pin is positioned in the die opening with one end thereof bearing against the working face of the backing plate and the other end thereof inset with respect to the face of the collet plate near the punch. The split defines die portions on opposite sides of the split which move laterally outwardly in cantilever fashion in response to downward movement of the punch as the material of the sheets to be joined flows into the die cavity defined by the die opening and the inset end of the anvil pin. The low profile provided by the die assembly allows the clinching tool to be utilized in relatively tight confines such as in a narrow channel section defined by the sheets to be joined.

23 Claims, 2 Drawing Sheets

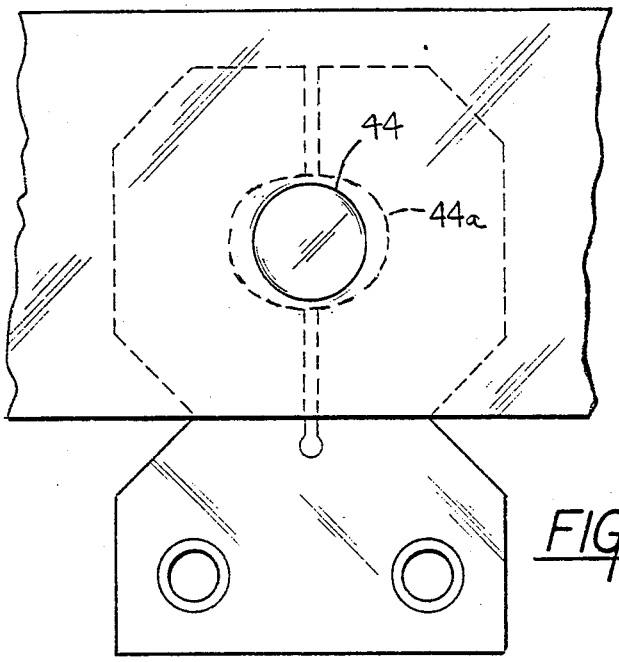
FIG. 5
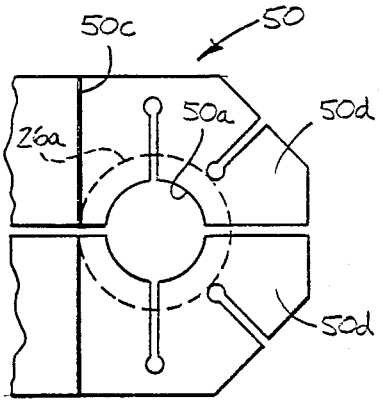
FIG. 8
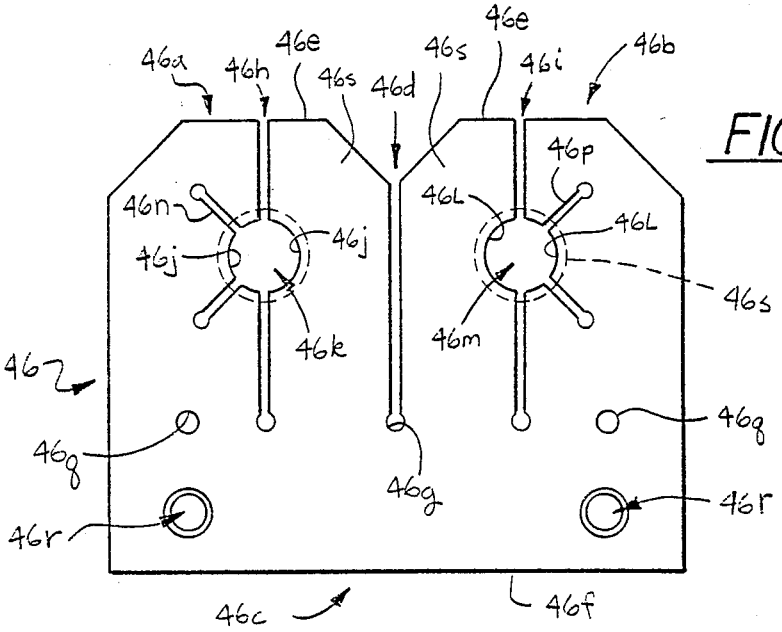
FIG. 6
FIG. 7
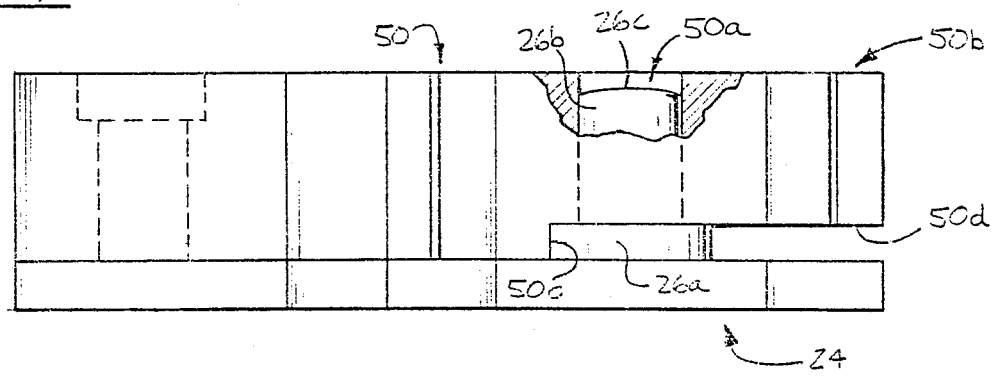

CLINCHING TOOL

RELATED APPLICATION

This application is a continuation-in-part of U.S. patent application Ser. No. 128,194, filed Dec, 3, 1987, now U.S. Pat. No. 4,825,525.

BACKGROUND OF THE INVENTION

This invention relates to tools for fastening two sheets of material together without welding or riveting and, more particularly, to a tool in which the sheets of material are fastened together in a clinching operation.

Sheets of material are most commonly fastened together by the use of welding or by the use of rivets. However, each of these methods has disadvantages. Specifically, welding entails high power requirements and large capital investment and cannot be used to fasten certain dissimilar materials, and riveting also requires high capital investment and produces a rather bulky joint that is unacceptable in many applications. In an effort to overcome the disadvantages of welding and riveting, clinching tools have been developed in which the sheets of material are deformed in a clinching operation to securely join the sheets together without the use of rivets and without the use of welds. Whereas these clinching tools have proven to be generally satisfactory in terms of producing a satisfactory joint as between the sheets of material, the available clinching tools are relatively bulky and therefore difficult if not impossible to use in tight confines such, for example, as in applications where the two sheets of material are configured to define a narrow channel structure.

SUMMARY OF THE INVENTION

This invention is directed to the provision of a clinching tool which is readily usable to perform a clinching operation even in very tight confines.

The invention clinching tool comprises a punch adapted to be mounted in a punch retainer for movement along a longitudinal punch axis and a die assembly for coaction with the punch. According to the invention, the die assembly includes a collet having a clinching section including die portions movable laterally relative to each other and defining a die opening therebetween centered on the longitudinal punch axis for receiving the punch as the latter is moved along the punch axis, and a base section integral with the clinching section and disposed laterally of the clinching section and laterally of the punch axis; and an anvil positioned in the die opening in inset relation to the face of the clinching section facing the punch to define a die cavity with the die portions. This specific arrangement, wherein the clinching section and the mounting section are formed integrally and in side by side relation minimizes the overall height of the clinching tool and allows the tool to be used in tight confines such as in a channel configuration.

According to a further feature of the invention, the collect comprises a flat plate member with the clinching section defined adjacent one end of the plate member and the base section defined adjacent an opposite end of the plate member. This arrangement allows a relatively thin plate member to comprise both the clinching section and the mounting section of the collet.

According to a further feature of the invention, the die opening comprises a through opening extending from face to face of the plate member and the die portions are defined by a split in the plate opening in the die opening. This arrangement provides a convenient and effective means of allowing the required lateral movement of the die portion in coaction with the movement of the punch.

According to a further feature of the invention, the split extends from the clinching end of the plate member and passes through the die opening to an inboard end positioned between the die opening and the base end of the plate member. This arrangement provides maximum lateral deflectability for the die portion to facilitate their coaction with the punch.

According to a further feature of the invention, the plate member is cut away along its opposite side edges proximate the inboard end of the split. This arrangement provides a hinge axis adjacent the cut aways to further facilitate the ready lateral outward movement of the die portions.

According to a further feature of the invention, the plate member includes further splits extending radially with respect to the punch axis and opening in an outer edge of the plate member. These splits further facilitate the laterally outward, opening movement of the die portion.

According to a further feature of the invention, the plate member further includes splits extending radially with respect to the punch axis and opening in the die opening. These further splits provide yet further flexing capability for the die portions.

In the disclosed embodiment of the invention, these further splits are arranged in circumferentially spaced relation around the punch axis with a split opening in the die opening alternating with a split opening in the outer edge of the plate member, moving in circumferential manner around the punch axis.

According to a further feature of the invention, the die opening includes a counterbore adjacent the face of the plate member remote from the punch, and the anvil comprises a pin having a head portion sized to fit in the counterbore and a shank portion extending from the head portion within the die opening. This arrangement provides positive positioning of the pin within the die opening and positive locating of the free end of the pin in inset relation with respect to the face of the clinching section facing the punch.

According to a further feature of the invention, the clinching tool further includes a backing plate having a configuration generally corresponding to the configuration of the collet plate member and adapted to be positioned with a working face thereof positioned against the face of the collet plate member remote from the punch and, in the assembled relation of the collet plate member, the backing plate, and the anvil pin, the anvil pin bears at one end thereof against the working face of the backing plate with its other end inset with respect to the face of the collet plate member near the punch. This arrangement provides positive positioning of the anvil pin within the die opening and provides a firm backing for the anvil to facilitate the clinching operation.

According to a further feature of the invention, the split in the collet comprises a first split and the die opening comprises a first die opening; the collet further includes a second split formed in the clinching end of the plate member and extending toward the base end of the plate member in generally parallel laterally spaced relation to the first split to form further die portions on either side thereof; and arcuate cut aways are provided along the opposite edges of the second split at a location intermediate the ends of the second split to define a second, generally circular die opening laterally spaced from the first die opening. This arrangement allows the collet to be configured to provide a plurality of die openings capable of performing a plurality of clinching operations in closely spaced lateral relation.

According to a further feature of the invention, the collet further includes a third split formed in the clinching end of the plate member between the first and second splits and extending toward the base end of the plate member in generally parallel relation to the first and second splits. This arrangement provides definition as between the die portions associated with the first and second die openings and facilitates the laterally outward movement of the die portions of the respective die openings.

BRIEF DESCRIPTION OF THE DRAWINGS

FIG. 5 is a fragmentary top view showing the completed clinching joint;

FIG. 6 is a view of a modified form of collet for use in the invention clinching tool;

FIG. 7 is a view of a further modified form of the invention collet for use in the invention clinching tool; and FIG. 8 is a fragmentary bottom view of the modified collet seen in FIG. 7.

DETAILED DESCRIPTION OF THE PREFERRED EMBODIMENTS

Figure 1:
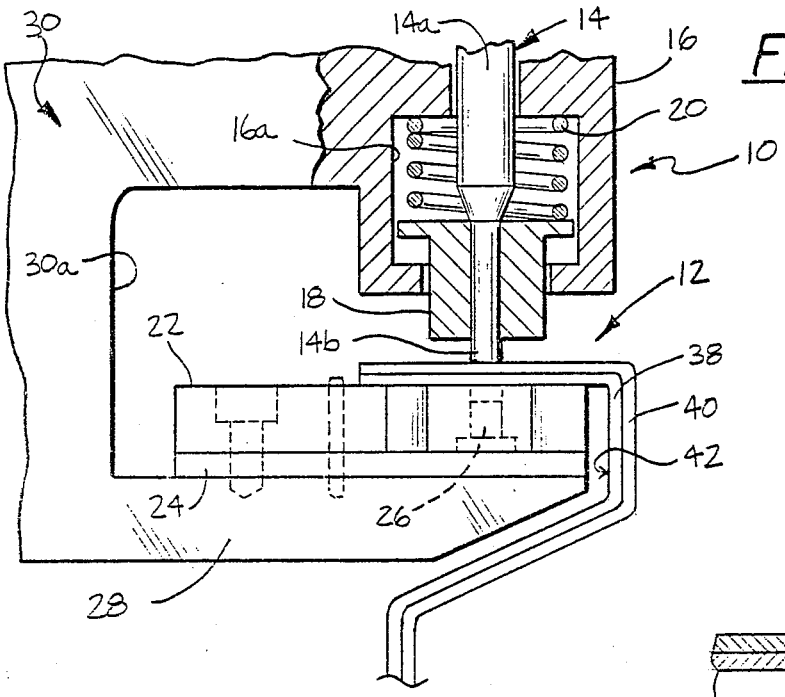
FIG. 1 is a fragmentary view of a clinching tool according to the invention.

The invention clinching tool includes a punch assembly 10 and a die assembly 12.

Punch assembly 10 includes a punch 14, a punch retainer 16, and a stripper 18 positioned in a cavity 16*a* defined by retainer 16 and urged downwardly by a compression spring 20. Punch 14 includes a main body portion 14*a* and a tip portion 14*b*.

Die assembly 12 is positioned beneath punch 14 and includes a collet 22, a backing plate 24, and an anvil 26. Die assembly 12 is mounted on a base or mounting member 28 which may comprise a separate support structure or may, as shown, be formed integrally with punch retainer 16 to constitute a C-shaped yoke 30 defining an opening 30*a* between die retainer 16 and base member 28.

Collet 22 is in the form of a flat plate and may for example comprise SAE L6 tool steel.

Collet plate 22 includes a clinching section 22*a* adjacent one end of the plate and a base or mounting section 22*b* adjacent the opposite end of the plate. A through split 22*c* opens in end edge 22*d* of the plate and extends toward the other end edge 22*e* of the plate to an inboard end 22*f* proximate but spaced from end edge 22*e*. Split 22 may be formed for example by drilling a small diameter hole in inboard split end 22*f* and then wire burning the split from the end edge 22*d* to the drilled hole 22*f*. Split 22*c* divides the clinching section of the collet into laterally opposed cantilevered die portions 22*g* and 22*h*. Arcuate cut-outs 22*i* are provided along the opposite side edges of split 22*c* and coact to define a generally circular die opening 22*j* positioned between collet end edge 22*d* and the inboard end 22*f* of the split but preferably closer to the collet end edge 22*d* than to the split inboard end 22*f*.

Collet plate 22 is further machined to provide beveled corner edges 22*k* and 221 and is further machined to provide V cut-outs 22*m* along each side edge of the plate defined in each case by an angled edge 22*n* and an angled edge 22*p*.

The clinching section 22*a* of the collet plate further includes further splits 22*g* extending radially with respect to die opening 22*j* and opening in the die opening and further splits 22*r* extending radially with respect to the die opening and opening in outer edges 22*k*, 221, and 22*n* of the collet plate. Each of the splits are formed by drilling a hole through the collet plate and then wire burning the split from the die opening, or from the outer edge of the plate, to the drilled hole. The further splits will be seen to be arranged in circumferentially spaced relation about the central axis of die opening 22*j* with the splits opening in the die opening alternating with the splits opening in the outer edges of the collet plate.

Clinching section 22*b* of the collet plate includes mounting means for the collet in the form of laterally spaced through holes 22*s* including counterbores 22*t*.

Collet plate 22 further includes laterally spaced dowel holes 22*u* on either side of split 22*c* in the vicinity of cut-outs 22*m*.

In a typical application, collet plate 22 may have a thickness of 0.375 inches, a length from end edge 22*d* to end edge 22*e* of 1.38 inches, and a width between the side edges 22*v* and 22*w* of 1.00 inches.

Arcuate cut-outs 22*i* defining die opening 22*j* are further provided with counterbore portions 22*x* so as to effectively provide a counterbore portion for die opening 22*j* at the face 22*y* of the collet plate remote from the punch 14.

Backing plate 24 is preferably formed of the same material as collet plate 22 (such for example as SAE L6 tool steel) and has a size and configuration generally matching the size and configuration of collet plate 22. Backing plate 24 includes apertures 24*a* corresponding to mounting holes 22*s* in collet plate 22 and dowel holes 24*b* corresponding to dowel holes 22*u* in collet 22. In the case of a collet plate having a thickness of 0.375 inches, backing plate 24 may have a thickness of 0.125 inches for an overall combined collet plate and backing plate thickness of 0.500 inches.

Anvil pin 26 is preferably formed of A2 tool steel and includes a head portion 26*a* and a shank portion 26*b*. Head portion 26*a* is sized to fit within the counterbore 22*x* defined by the collet plate and shank portion 26*b* has a diameter sized to fit snugly within die opening 22*j* in the relaxed position of the die portions of the collet plate and has a length such that, with head portion 26*a* positioned in counterbore 26*x*, the free end 26*c* of shank portion 26*b* is inset with respect to the face 22*z* of the collet plate so as to coact with die opening 22*i* to form a die cavity 32.

In the assembled relation of the collet plate 22, backing plate 24, and anvil pin 26, the working face 24*c* of the backing plate is positioned against the remote face 22*y* of the collet plate and the head portion 26*a* of the anvil pin bears against the working face 24*c* of the backing plate with the shank portion 26*b* of the anvil pin extending within the die opening 22*j* to an inset location with respect to the near face 22z of the collet plate to define the die cavity 32.

The die assembly, including collet plate 22, backing plate 24, and anvil pin 26, is mounted to the base member portion 28 of yoke 30 by the use of threaded and headed fastener members 34 passing through mounting holes 22s in collet plate 22 and through mounting holes 24a in backing plate 24 for threaded engagement with suitable tapped bores in base member 28 with the head portions 34a of the fasteners 34 seated in counterbores 22t, so as to present a flush disposition with respect to the near face 22z of the collet plate, and with dowel pins 36 passing through dowel holes 22u in collet plate 22 and through dowel holes 24b in backing plate 24 for receipt in dowel holes provided in base member 28. The fasteners 34 positively clamp the die assembly to the base member 28 and the dowel pins 36 coact with the fasteners to positively preclude movement of the die assembly relative to the base member 28.

The invention clinching tool is especially suitable for use in fastening together two sheets of material 38 and 40 which are configured to define a narrow channel section 42 presenting a tightly confined area which is difficult if not impossible to access using prior art clinching tools. Such channel sections are encountered for example on door headers for automobiles and along the flange portions of refrigerator doors. The invention tool assembly, by virtue of the extremely shallow profile provided by the collet plate in combination with the backing plate, may readily enter the channel 42 to position the die opening 22j beneath the plates 38 and 40 and in longitudinal alignment with the central axis of punch 14, whereafter the punch 14 may be actuated in suitable manner to deform the sheets 38 an 40 in coaction with 15 the die opening 22j and the anvil pin 26 to form a clinched joint 44 securely bonding the two sheets together.

Figure 4:
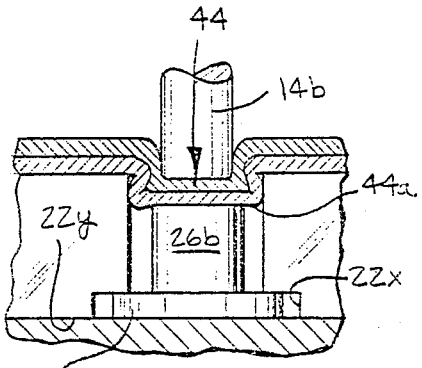
FIG. 4 is a detail view showing the clinching flow of the sheets of material being joined.
Figure 2:
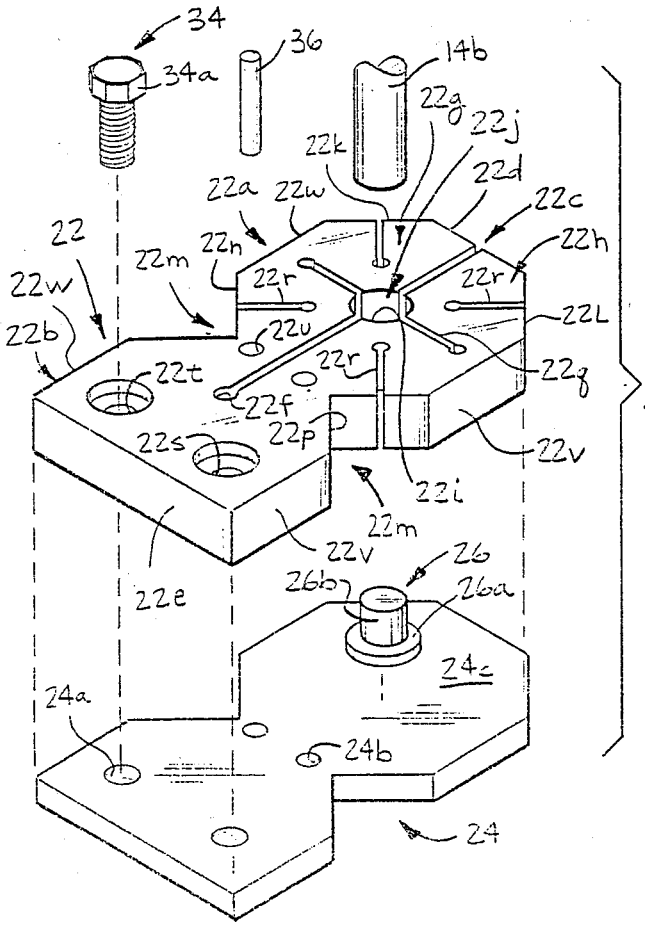
FIG. 2 is an exploded perspective view of the invention clinching tool.
Figure 3:
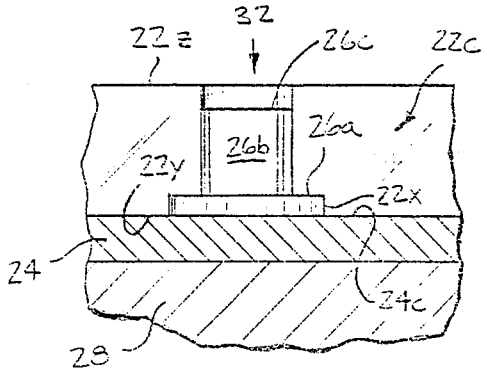
FIG. 3 is a detail view of a portion of the invention clinching tool.

Specifically, as the punch 14 is moved downwardly along the punch axis, the punch tip portion 14b contacts the upper sheet 40, and with continued downward movement, causes the adjacent material of sheets 38 and 40 to flow into the die cavity 32. This flowing movement, filling the inset defined by the anvil pin in coaction with the die portions 22g and 22h, is best seen in FIG. 4. As the punch continues, downwardly, cantilever die portions 22g and 22h move radially and laterally outwardly about the axis defined by split inboard end 22f to allow the adjacent material of sheets 38 and 40 to flow radially and laterally outwardly into the annular space defined by the laterally retreating die portions and the shank portion 26b of the anvil pin. As seen in FIG. 4, the radially outwardly flowing material also tends to flow downwardly around the sides of pin shank portion 26b to form a coin 44a extending around the periphery of the clinching joint. Because the die portions 22g and 22h move substantially laterally radially outwardly in response to the advancing punch, the coined edge 44a of the clinching joint 44 is thickest adjacent the lateral side edges of the joint and thinnest adjacent the forward and rearward edges of the joint so as to present a generally elliptical appearance, as seen in FIG. 5. The coined edge 44a of the joint is clinched or folded back up against the undersurface of sheet 38 through a full 180° so as to be tightly pressed against the undersurface of sheet 38 and present a tight, low profile clinched joint which is effective to positively join the two sheet together but which is dimensionally and aesthetically unobtrusive. After the joint has been formed, punch 14 is moved upwardly and the joined sheets 38 and 40 are separated from the lower end of the punch by the action of stripper 18.

The invention clinching tool thus readily provides an effective clinching joint in a severely confined area. The joint formed by the invention clinching tool rigidly joins the sheets 38 and 40 together; has a low profile by virtue of the total folding of the coined edge 44a back up against the under surface of lower sheet 38; has an aesthetically pleasing appearance; and is leakproof since neither the material of upper sheet 38 nor the material of lower sheet 40 has been cut through in the clinching process. The joint formed by the invention clinching tool is particularly suited for joining relatively thin sheet material and may typically replace a weld joint.

The modified collet seen in FIG. 6 is utilized when it is desired to provide two clinch joints in relatively close laterally spaced relation. The collet plate 46 seen in FIG. 6 includes first and second clinching sections 46a and 46b proximate one end of the plate and a mounting portion 46c proximate the other end of the plate. Clinching section 46a is divided from clinching section 46b by a central split 46d extending from end edge 46e of the plate toward the opposite end edge 46f and terminating proximate but spaced from the edge 46f. As with the collet plate of FIGS. 1–5, split 46d may be formed by drilling a hole 46g through the plate and then wire burning the split 46d from edge 46e to hole 46g. Plate 46 further includes a second split 46h on one side of central split 46d and a third split 46i on the other side of central split 46d.

Split 46h extends from plate edge 46e to a location proximate but spaced from plate edge 46f in generally parallel relation to central split 46d and is provided with arcuate cut-outs 46j along its opposite side edges at a location between the ends of the splits to define a first die opening 46k.

Split 46d extends from plate edge 46e to a location proximate but spaced from plate edge 46f and is generally parallel to splits 46d and 46h. Arcuate cutouts 46l along the opposite side edges of the split at a location intermediate the ends of the split define a second die opening 46m in laterally spaced relation to first die opening 46k. Radial splits 46n are provided in association with die opening 46k and open in the die opening 46k, and radial splits 46p are provided in association with die opening 46m and open in the die opening 46m. All of the splits are formed by drilling a hole at the inboard end of the split and then wire burning the split. Plate 46 further includes dowel pin openings 46q and counterbored mounting holes 46 r.

It will be understood that a backing plate conforming in size and configuration to collet plate 46 will be provided; that anvil pins 26 will be provided in association with each die opening 46k and 46m, with each pin including a head portion 26a seating in a counter bore 46s provided in the associated die opening and bearing against the working surface of the backing plate; and that the die assembly, comprising the collet plate 46, the associated backing plate, and the associated anvil pins, will be mounted to a backing structure such as the structure 28 by the use of fasteners passing through mounting holes 46r and through the associated backing plate fastener holes and by dowel pins passing through dowel openings 46q and through the associated backing plate dowel holes, in the manner described with respect to the FIGS. 1–5 embodiment.

The collet plate of FIG. 6, when used in association with a plurality of matching punches, may be used in the narrow confines such as shown by the channel section of FIG. 1 and, additionally, may provide very tightly spaced clinch joints along the length of the channel section since the die openings 46*k* and 46*m* need only be spaced laterally by a distance sufficient to provide a narrow die portion 46*s* on either side of central split 46*d*. The invention of course contemplates that more than two closely spaced die openings may be provided by a single collet plate.

The modified collet seen in FIGS. 7 and 8 is generally similar to the collet described with respect to FIGS. 1–5 with the exception that the circular die opening 50*a* of the collet 50 is not provided with a counter bore at its lower end but rather the collect plate is relieved adjacent the free end of the clinching section 50*b* of the collet to provide a vertical shoulder 50*c* extending transversely of the collet rearwardly of the die opening 50*a* and a horizontal relief surface 50*d* extending from the vertical shoulder 50*c* to the free outer end of the clinching section. The distance from the vertical edge 50*c* to the nearest point on the cutout opening 50*a* approximates the difference between the radius of the head portion 26*a* of the anvil pin and the radius of the shank portion 26*b* of the anvil pin so that, with the anvil pin seated in die opening 50*a*, the outer periphery of head portion 26*a* is positioned against the vertical edge 50*c* so as to properly position the pin within the die opening 50*a*. Also as seen in the FIG. 7 and 8 embodiment, the top of the shank portion 26*b* of the pin need not be flat, as shown in the collet of FIGS. 1–5, but may instead be domed as seen at 26*c*. The domed head of the shank portion of the anvil pin has the effect of more readily forcing the center of the material of the sheets 38 and 40 radially outwardly to form the rivet so as to provide better material flow and less power requirements, at least for certain applications.

Whereas preferred embodiments of the invention have been illustrated and described in detail, it will be apparent that various changes may be made in the disclosed embodiments without departing from the scope or spirit of the invention.

We claim:

1. A clinching tool for fastening two sheets of material together, said tool comprising:

(A) a punch adapted to be mounted in a punch retainer for movement along a longitudinal punch axis; and (B) a die including (1.) a collet formed as a unitary generally planar member and including a clinching section defined proximate one end of said planar member and including integral die portions movable resiliently laterally relative to each other and defining a die opening therebetween centered on said longitudinal axis for receiving said punch as the latter is moved along said longitudinal axis, and a base section defined proximate another end of said planar member integral with said clinching section and disposed laterally of said clinching section and laterally of said axis, said planar member being formed as a plate having a substantially uniform thickness throughout its width and length, and (2.) an anvil positioned in said die opening in inset relation to the face of said clinching section facing said punch to define a die cavity with said die portions.

2. A clinching tool according to claim 1 wherein:

(C) said collet comprises a flat plate member;

(D) said clinching section is defined adjacent one end of said plate member; and (E) said base section is defined adjacent an opposite end of said plate member.

3. A clinching tool according to claim 2 wherein:

(F) said die opening comprises a through opening extending from face to face of said plate member; and (G) said die portions are defined by a split in said plate member opening in said die opening.

4. A clinching tool according to claim 3 wherein:

(H) said die opening includes a counterbore adjacent the face of said plate member remote from said punch; and (I) said anvil comprises a pin having a head portion sized to fit in said counterbore and a shank portion extending from said head portion within said die opening.

5. A clinching tool according to claim 3 wherein:

(H) said clinching tool further includes a backing plate having a configuration generally corresponding to the configuration of said collet plate member and adapted to be positioned with a working face thereof positioned against the face of said collet plate member remote from said punch; and (I) in the assembled relation of said collet plate member, said backing plate, and said anvil, said anvil bears at one end thereof against said working face of said backing plate with its other end inset with respect to the face of said collet plate member near said punch.

6. A clinching tool according to claim 5 wherein:

(J) said die opening includes a counterbore adjacent said remote face of said collet plate member; and (K) said anvil comprises a pin having a head portion positioned in said counterbore and bearing against said working face of said backing plate and a shank portion extending from said head portion toward said near face of said collet plate member.

7. A clinching tool for fastening two sheets of material together, said tool comprising:

(A) a punch adapted to be mounted in a punch retainer for movement along a longitudinal punch axis; and (B) a die including (1.) a collet having a clinching section including die portions movable laterally relative to each other and defining a die opening therebetween centered on said longitudinal axis for receiving said punch as the latter is moved along said longitudinal axis, and a base section integral with said clinching section and disposed laterally of said clinching section and laterally of said axis, and (2.) an anvil positioned in said die opening in inset relation to the face of said clinching section facing said punch to define a die cavity with said die portions;

(C) said collet comprising a flat plate member;

(D) said clinching section being defined adjacent one end of said plate member;

(E) said base section being defined adjacent an opposite end of said plate member;

(F) said die opening comprising a through opening extending from face to face of said plate member; and (G) said die portions being defined by a split in said plate member extending from said one end of said plate member and passing through said die opening to an inboard end positioned between said die opening and said opposite end of said plate member.

8. A clinching tool according to claim 7 wherein:

(I) said plate member is cut away along its opposite side edges proximate the inboard end of said split.

9. A clinching tool according to claim 7 wherein:

(I) said plate member includes further splits extending radially with respect to said axis and opening in an outer edge of said plate member.

10. A clinching tool according to claim 7 wherein:

(I) said plate member includes further splits extending radially with respect to said axis and opening in said die opening.

11. A clinching tool according to claim 7 wherein:

(I) said plate member includes further splits extending radially with respect to said axis and opening in an outer edge of said plate member and still further splits extending radially with respect to said axis and opening in said die opening; and (J) said further splits and still further splits are arranged in circumferentially spaced relation around said axis.

12. A clinching tool according to claim 11 wherein:

(K) said further splits alternate with said still further splits moving in circumferential manner around said axis.

13. A collet for use with a punch member to form a clinching tool for fastening two sheets of material together, said collet comprising:

(A) a unitary plate member having end edges and side edges, said plate member having a substantially uniform thickness through its width and length;

(B) a split formed in one end edge of said plate member and extending toward the other end edge of said plate member to form integral die portions on either side of said split movable laterally outwardly in cantilevered fashion during the clinching operation;

(C) arcuate cut-aways along both edges of said split at a location intermediate the ends of said split coacting to define a generally circular die opening; and (D) mounting means proximate the other end edge of said plate member to facilitate mounting of said plate member to a support surface.

14. A collet for use with a punch member to form a clinching tool for fastening two sheets of material together, said collet comprising:

(A) a plate member having end edges and side edges;

(B) a split formed in one end edge of said plate member and extending toward the other end edge of said plate member to form die portions on either side of said split;

(C) arcuate cut-aways along both edges of said split at a location intermediate the ends of said split coacting to define a generally circular die opening; and (D) mounting means proximate the other end edge of said plate member to facilitate mounting of said plate member to a support surface;

(E) said side edges being cut-away adjacent the inboard end of said split to form a weakened hinge area intermediate the ends of the plate member to facilitate the cantilevered laterally outward movement of said die portions.

15. A collet according to claim 14 wherein:

(F) said plate member includes further splits extending radially with respect to the central axis of said die opening and opening in an edge of said plate member.

16. A collet according to claim 15 wherein:

(G) said plate member includes still further splits extending radially with respect to the central axis of said die opening and opening in said die opening.

17. A collet according to claim 16 wherein:

(H) said further splits and still further splits are arranged in circumferentially spaced relation around said axis.

18. A collet according to claim 17 wherein:

(I) said further splits alternate with said still further splits moving in circumferential manner around said axis.

19. A collet assembly for use with a punch for fastening two sheets of material together, said assembly comprising:

(A) a unitary collet plate having a clinching section proximate one end thereof including integral resilient die portions formed by a split in said plate and movable resiliently laterally relative to each other in coaction with movement of the punch along said longitudinal axis and defining a die opening therebetween extending through said plate and adapted to be centered on the longitudinal axis of the punch, said collet plate having a substantially uniform thickness throughout its width and length;

(B) a backing plate having a configuration generally matching the configuration of the collet plate and having a working face adapted to be positioned against one face of said collet plate; and (C) a pin having a diameter sized to fit in said die opening and having a length such that with one end thereof bearing against said working face of said backing plate, the other end thereof is inset with respect to the other face of said collet plate to coact with said die portions to define a die cavity.

20. A collet assembly according to claim 19 wherein:

(D) said split in said collet plate extends from said one end of said collet plate and passes through said die opening.

21. A collet assembly according to claim 20 wherein:

(E) said die opening includes a counterbore adjacent said one face of said collet plate; and (F) said pin includes a head portion sized to fit in said counterbore and a shank portion extending from said head portion within said die opening toward said other face of said collet plate.

22. A collet for use with a punch member to form a clinching tool for fastening two sheets of material together, said collet comprising:

(A) a plate member having end edges and side edges;

(B) a split formed in one end edge of said plate member and extending toward the other end edge of said plate member to form die portions on either side of said split;

(C) arcuate cut-aways along both edges of said split at a location intermediate the ends of said split coacting to define a generally circular die opening;

(D) mounting means proximate the other end edge of said plate member to facilitate mounting of said plate member to a support surface;

(E) said split comprising a first split in said die opening comprising a first die opening;

(F) said collet further including a second split formed in said one edge of said plate member and extending toward said other end of said plate member in generally parallel, laterally spaced relation to said first split to form further die portions on either side thereof;

(G) arcuate cut-aways being provided along the opposite edges of said second split at a location intermediate the ends of said second split to define a second generally circular die opening laterally spaced from said first die opening.

23. A collet according to claim 22 wherein:

(H) said collet further includes a third split formed in said one edge of said plate member between said first and second splits and extending toward said other end of said plate member in generally parallel relation to said first and second splits.

* * * * *